US005576485A

United States Patent [19]

Serata

[11] Patent Number: 5,576,485

[45] Date of Patent: Nov. 19, 1996

[54] SINGLE FRACTURE METHOD AND APPARATUS FOR SIMULTANEOUS MEASUREMENT OF IN-SITU EARTHEN STRESS STATE AND MATERIAL PROPERTIES

[76] Inventor: Shosei Serata, 3640 Ridgewood Way, Richmond, Calif. 94806

[21] Appl. No.: 415,196

[22] Filed: Apr. 3, 1995

[51] Int. Cl.[6] ..... G01N 33/24; E21B 47/00; G01V 1/00

[52] U.S. Cl. ..... 73/152.17; 73/783; 166/207; 166/271; 166/101

[58] Field of Search ..... 73/151, 152, 783, 73/784; 166/212, 207, 271, 101

[56] References Cited

U.S. PATENT DOCUMENTS

| | | | |
|---|---|---|---|
| 2,812,025 | 11/1957 | Teague et al. | 166/207 |
| 3,477,506 | 11/1969 | Malone | 166/207 |
| 3,796,091 | 3/1974 | Serata | 73/88 E |
| 4,149,409 | 4/1979 | Serata | 73/151 |
| 4,461,171 | 7/1984 | de la Cruz | 73/151 |
| 4,599,904 | 7/1986 | Fontenot | 73/783 |
| 4,641,520 | 2/1987 | Mao | 73/151 |
| 4,733,567 | 3/1988 | Serata | 73/784 |
| 4,858,130 | 8/1989 | Widrow | 364/421 |
| 4,899,320 | 2/1990 | Hearn et al. | 367/35 |
| 5,381,690 | 1/1995 | Kanduth et al. | 73/151 |

*Primary Examiner*—Hezron E. Williams
*Assistant Examiner*—J. David Wiggins
*Attorney, Agent, or Firm*—Howard Cohen

[57] ABSTRACT

A method and apparatus for measuring ambient stress states and material properties in underground media includes a borehole probe having a cylindrical tube formed of soft, elastic polymer material secured about a central mandrel. An upper end cap assembly removably secures the probe to a service module to provide high pressure hydraulic fluid and sensor connections. A distal end cap seals the tube to the mandrel, so that hydraulic pressure causes diametrical expansion of the tube. The end cap includes an annular seal formed of elastic polymer material and helical springs that are embedded therein in the circumferential direction. The interiors of the helical springs are filled with steel pins or balls to prevent deformation of the springs. High strength fibers are bonded in the outer surfaces of the annular seal and oriented longitudinally to permit radial expansion of the seal assembly without hydraulic leakage or extrusion of the soft polymer of the cylindrical tube. An inner laminar layer comprised of high strength fiber extending circumferentially about the tube defines a datum plane extending through the axis of the tube, so that the tube is expandable only in one diametrical direction. An outer laminar layer of braided steel wire mesh limits longitudinal expansion of the tube and provides a high friction outer surface for the tube. A plurality of LVDT sensors are aligned with the direction of diametrical expansion and spaced longitudinally. High pressure hydraulic fluid expands the outer tube, to drive the high friction outer surface into the borehole wall, consolidating the borehole boundary. The fracture pressures at various angles are recorded, and analyzed to yield the principal stress vectors and material properties of the underground media.

36 Claims, 12 Drawing Sheets

SINGLE FRACTURE METHOD AND APPARATUS FOR SIMULTANEOUS MEASUREMENT OF IN-SITU EARTHEN STRESS STATE AND MATERIAL PROPERTIES

BACKGROUND OF THE INVENTION

In recent years numerical methods for the analysis of underground structures have advanced rapidly, creating a sophisticated array of mathematical tools for the design and evaluation of structures such as tunnels, mine structures, underground openings building foundations, dams and other large civil engineering projects, and the like. To fully exploit the precision and power of these mathematical methods, it is necessary to provide accurate input data to their computer programs regarding the stress state and material properties of the earthen media which will host the underground structure. Unfortunately, the development of instruments for acquiring the required in situ data has lagged far behind the numerical methods and the software that generally embodies these methods. Furthermore, even if the required data had been obtained, there is still no reliable means to examine the validity of the outcome of such numerical analysis. Thus mining and civil engineering design are hampered by a lack of reliable, precise data.

Conventional methods for measuring the needed in situ stress state of underground media include overcoring, hydrofracturing, core relaxation, borehole slotting, and related techniques. Overcoring is practical only in earthen media that is close to a (theoretically) idealized state, which is seldom found in the real world, and hydrofracturing is applicable only in uniform, isotropic non-fractured ground. All the other stress measurement methods are found to be not very useful in practice. Instruments such as a presiometer or Goodman jack are designed only to measure material properties, but not stress states. At present, therefore, there is no instrument which is capable of measuring both stress states and material properties simultaneously. To measure both, a combination of techniques must be used, an approach that can be burdensome and synergistically inaccurate. None of these approaches provides an opportunity for continuous monitoring or periodic measurement of stress state and material properties in underground media, and changes in stress state and material properties may be critical in early detection of catastrophic events such as rock bursting, opening deterioration, mine failure, earthquake, landslide, or the like.

The state of the art in instruments for measuring material properties and stress state in earthen media is described in U.S. Pat. No. 4,733,567 to Serata. This device includes a sealed plastic cylinder placed in a borehole and inflatable by hydraulic pressure to expand uniformly against the borehole wall. A plurality of LVDT sensors are arrayed diametrically within the cylinder to detect fracturing of the borehole. The expansion pressure is increased until initial fracturing is achieved, indicating that the combined tensile strength of the media and the ambient stress have been exceeded. By deflating and then repeating the process, the tensile strength and the principle stress vectors may be resolved. This approach is effective in homogenous media under certain restricted stress states, but is less successful in media having non-uniformities discontinuities, microfractures or prefractures, or viscoplastic characteristics. Also, it is not applicable to continuous automated monitoring and recording of underground stress states.

Thus the prior art lacks an effective technique and instrument for simultaneously providing accurate and reliable data on stress states and material properties, and it is not possible to take full advantage of the powerful numerical methods now available for analysis, design, and safety assurance of underground structures.

SUMMARY OF THE INVENTION

The present invention generally comprises a method and apparatus for measuring ambient stress states and material properties in underground media. The invention has the advantages of simultaneously measuring both stress state and material properties, and operating in non-idealized earthen media.

The apparatus comprises a borehole probe which includes a cylindrical tube formed of soft, elastic polymer material secured about a central mandrel that is joined to a proximal bulkhead end cap assembly. The end cap assembly is removably secured to a service module that provides a source of high pressure hydraulic fluid and electronic connections. A distal end cap assembly seals the tube, so that hydraulic pressure causes diametrical expansion of the tube. Each end cap assembly includes a cup-like end cap formed of high strength steel and secured to an end of the central mandrel, the cap having an outwardly flared open end which receives a respective end of the cylindrical tube. An annular seal assembly is interposed about the cylindrical tube within the flared opening of the end cap. The seal assembly is formed of elastic polymer material, in which a plurality of helical springs are embedded and oriented in the circumferential direction. The interior spaces of the helical springs are filled with steel pins or balls to prevent deformation or crushing of the springs. High strength fibers are bonded in the outer surfaces of the annular seal, and oriented in a longitudinal direction. The fiber laminate and the springs permit radial expansion of the seal assembly without hydraulic leakage or extrusion of the soft polymer of the cylindrical tube.

Secured to the outer surface of the tube are lamina which control and direct the expansion of the tube. An inner laminar layer comprises high strength fiber extending circumferentially about the tube. The fibers are discontinuous along a datum plane extending through the axis of the tube, so that the tube is expandable only in one diametrical direction. An outer laminar layer comprises a mesh of braided steel wire or high strength fiber which both limits longitudinal expansion of the tube and provides a high friction outer surface for the tube.

A plurality of LVDT sensors disposed within the tube are aligned with the direction of diametrical expansion and spaced longitudinally. The LVDT sensors are secured to removable plugs in the tube wall for easy replacement, and are joined through quick connect couplings to electronic devices within the service module. A steel anchor pin extends diametrically through the central mandrel and the outer tube in a medial portion of the assembly to maintain longitudinal registration of the tube and mandrel during expansion.

The probe is placed in a borehole and high pressure hydraulic fluid is applied within the probe to cause the cylindrical tube to expand diametrically from the datum plane. The high friction outer surface is driven into the borehole wall, consolidating the borehole boundary and compressing boundary microfractures and discontinuities. As the pressure increases, the borehole is fractured along the preset plane, and the fracture separation is recorded in relation to the applied pressure. The probe is then deflated, the probe is rotated about the longitudinal axis, and the process is reiterated. The relationship of fracture pressures versus separation at various angles are recorded, and mathematical analysis is carried out by the data acquisition system equipped in the service module, yielding the principal stress vectors and material properties of the underground media. In addition, the differences in expansion of the plurality of LVDTs arrayed along the length of the probe can provide data on variations on material properties in the borehole direction.

A critical aspect of the invention is the direct measurement of the actual distribution of tangential stresses and material behavior at a plurality of single fracture planes determined solely by selected orientations of the probe, without dependence upon any preconceived assumptions on the material properties and conditions of the ground. The ambient stress state and material properties are calculated by processing the observed data using finite element computer analysis techniques adapted specifically for this purpose.

DESCRIPTION OF THE PREFERRED EMBODIMENT

The present invention generally comprises a method and apparatus for measuring ambient stress states and material properties in underground media. A salient feature of the invention is that it permits simultaneous measurement of both stress state and material properties with a highly computerized data acquisition and analysis system to produce results on-site in real time. Also, it is designed to operate and derive accurate data even in non-idealized earthen media, which is not obtainable with any available means.

Figure 1:
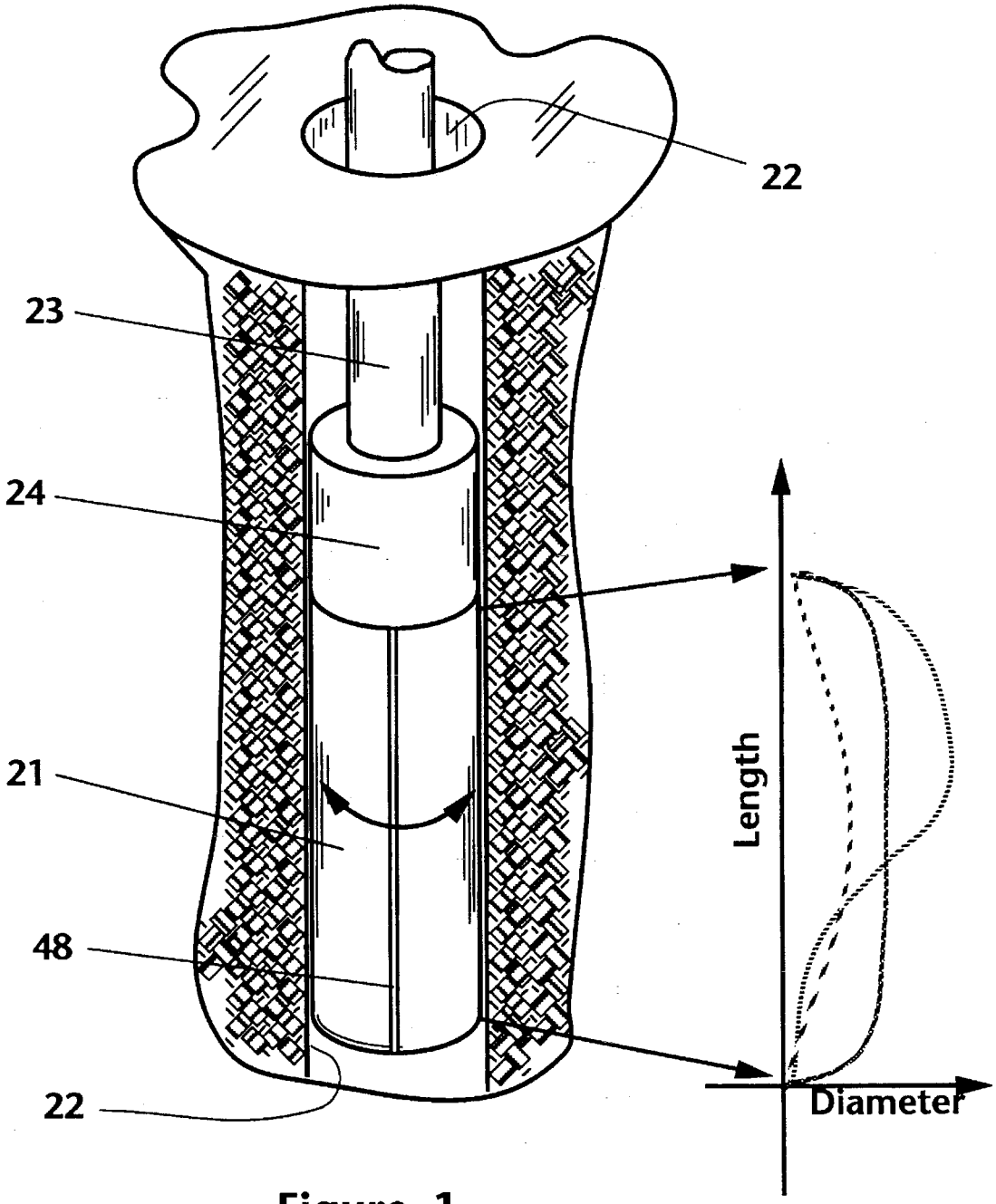
FIG. 1 is a schematic representation of the apparatus of the invention disposed within a borehole to measure ambient stress states and material properties of underground media.

With regard to FIG. 1, the apparatus of the invention includes a loading section 21 adapted to be placed within a borehole 22 at a depth chosen for measurement of underground stress state and material properties. The probe 20 consists of the loading section 21 and an electronic instrument section 24 which is supported by an operating tube. This tube contains a high pressure hydraulic fluid line and electrical cable (both not shown) connected to the operating equipment (hydraulic pump, power supply, computer and recorder) outside the borehole.

Figure 2:
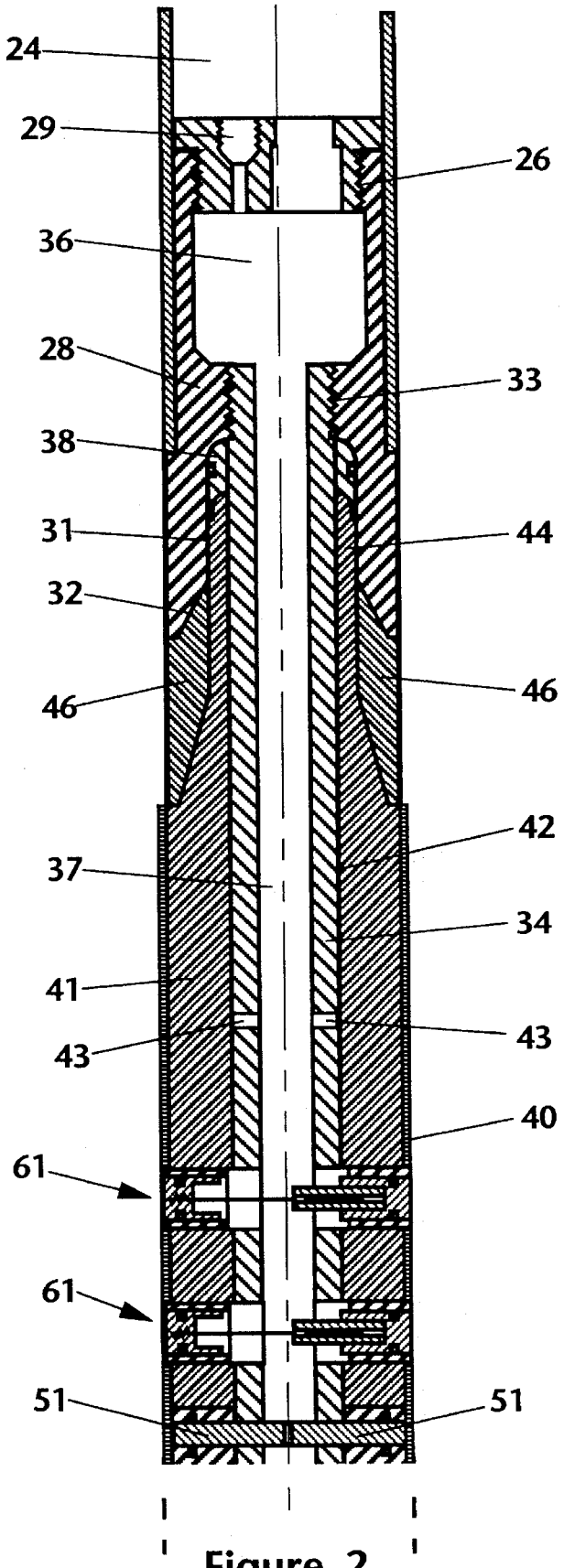
FIG. 2 is a partial longitudinal cross-sectional view of the apparatus of the invention, showing the proximal and medial portions of the probe.

Referring to FIG. 2, the electronic section 24 terminates at the bulkhead 27. The loading section 21 includes a basal end cap 28 having a bore 31 extending therethrough. The upper end of the bore 31 is provided with internal threads 26 to engage the threads of the bulkhead 27, so that the entire loading section 21 may be secured to and removed from the instrument section by this threaded engagement. A major component of the probe is a hollow tubular mandrel 34 which extends substantially the entire length of the loading section. The mandrel 34 is secured by threads 33 within the basal end cap 28. A fluid pressure chamber 36 defined between the end cap and the bulkhead provides a space for electronic connections in the high pressure environment that is a part of the interior space 37 of the mandrel. Thus, high pressure hydraulic fluid is sealed within the loading section, as will be describe below. A bushing 38 securing an O-ring seal is disposed at the conjunction of the basal end of the mandrel 34 and the interior bore 31 of the basal end cap to contain the pressurized fluid.

The loading section further includes a tubular expansion member 41 secured concentrically about the mandrel 34. The expansion member 41 is disposed to contain the high pressure hydraulic fluid delivered from the mandrel to the annular interstitial space 42 through a plurality of radial holes 43 in the mandrel 34. The member 41 is formed of a soft, elastic polymer material such as polyurethane. An annular seal 46 having a wedge-shaped cross-section is interposed between the flared end 32 of the basal end cap 28 and the tapered surface of the expansion member 41. The seal 46 is formed of a relatively hard elastic polymer material which has greater resistance to expansion than the member 41 to provide a transition between the expanded member 41 and the inner end of the rigid basal end cap 28. The seal 46 thus protects the member 41 from damage or rupture by impingement at the inner end of the basal end cap.

Figure 3:
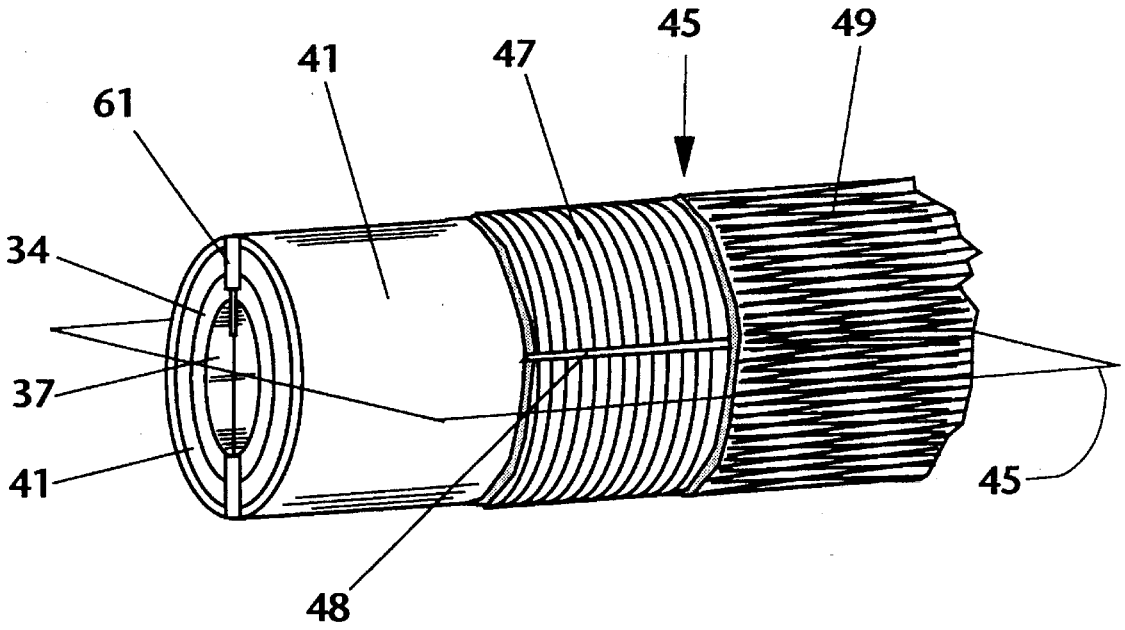
FIG. 3 is a partially cutaway view of the probe, showing in particular the cylindrical tube and the outer laminar layers.

Referring to FIG. 3, the expansion member 41 includes outer surface lamina 40 which control and direct the expansion of the member 41 during inflation by the high pressure hydraulic fluid. A layer 47 of high strength fiber (Kevlar or equivalent) is bonded to the surface of the member 41, the fiber being oriented circumferentially and circumscribing the tubular member 41. A pair of slots 48 extend longitudinally through the fibers of the layer 47, the slots extending in a fracture plane 45 that intersects the longitudinal axis of the tubular expansion member. In addition, an outer laminar layer 49 of metal wire mesh is also bonded to the member 41 together with the layer 47. The wire mesh is comprised of individual wires extending generally longitudinally and mutually intersecting at acute angles, so that the wires restrict longitudinal deformation of the member 41 during expansion. The wire mesh of the layer 49 is especially made to have a high friction surface to engage the surface of the borehole wall.

Figure 11:
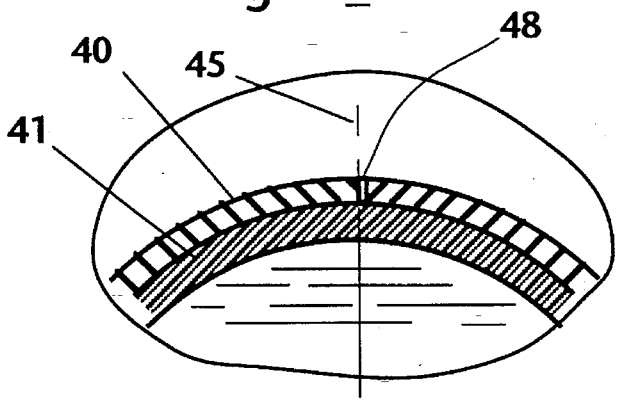
FIGS. 11 and 12 are sequential views depicting quiescence and expansion of the probe along the datum plane.
Figure 12:
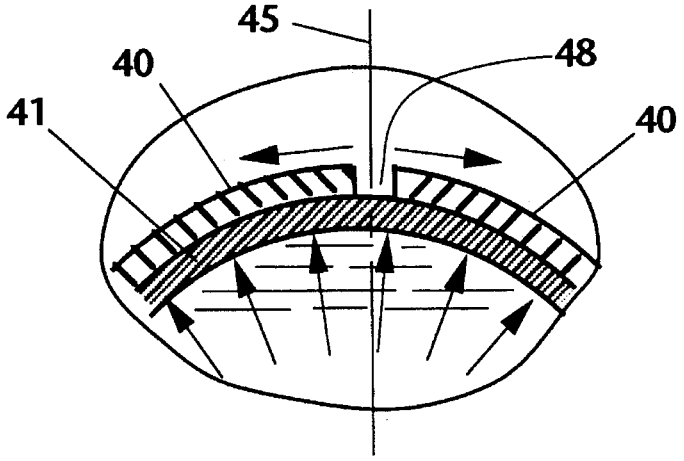

The wires of the layer 47 are not placed along (or are removed from)the slots 48 in the layer 47, so that the slots 48 may be the loci of expansion of the member 41. As shown in FIG. 11, the slot 48 is generally closed during the quiescent condition, but it widens circumferentially during inflation of the member 41 (FIG. 12). Thus the hydraulic pressure drives the member 41 to expand diametrically to diverge from the fracture plane 45. An important result of this directed probe expansion is that it causes the fracture plane formed by the probe in the borehole wall to coincide with the datum plane 45, regardless of pre-existing fractures, micro-fractures, or other anomalous conditions in the underground media. Thus this directed expansion overcomes a major drawback in prior art instruments, which is the inability to produce reliable data in the presence of such pre-existing conditions.

Figure 7:
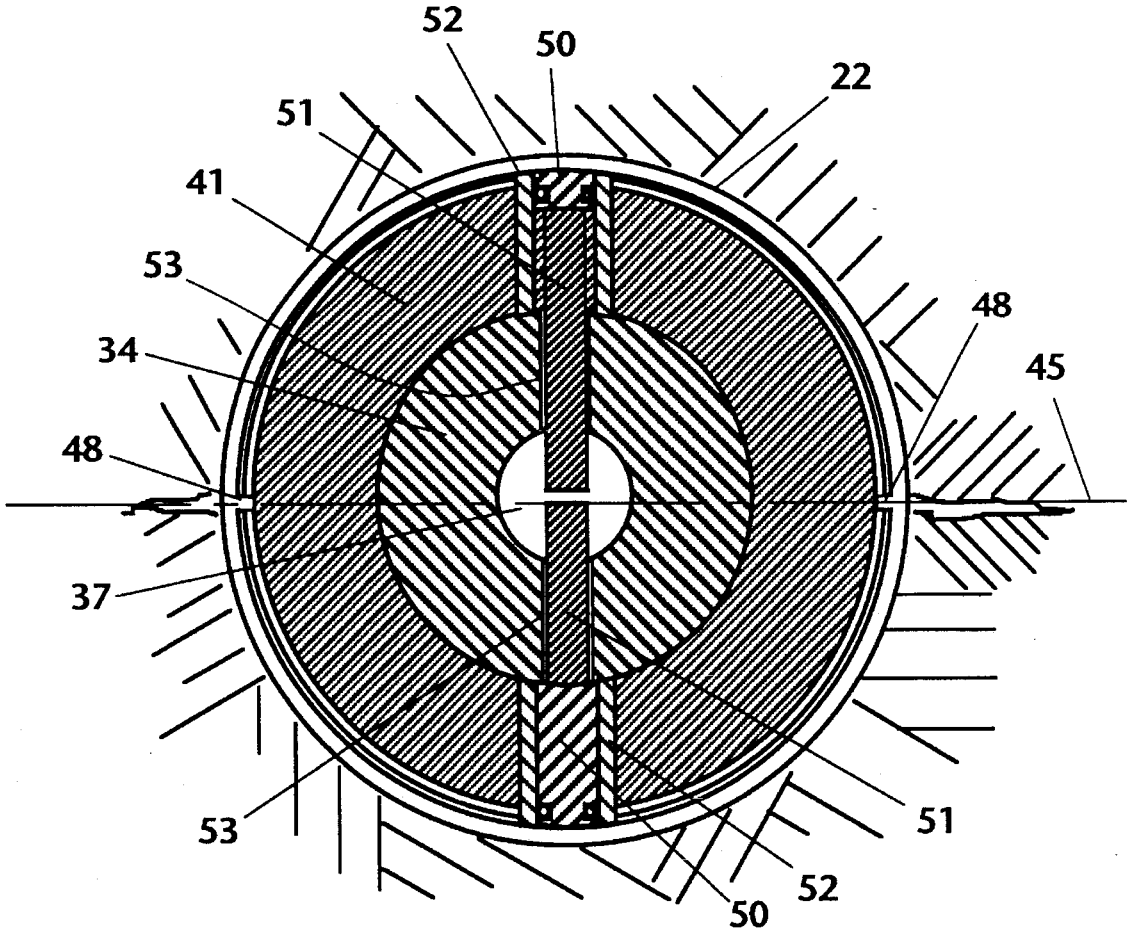
FIG. 7 is a cross-sectional end view of locating pins disposed at a medial portion of the probe.

The loading section 21 further includes a pair of anchor pins 51 extending colinearly, diametrically, and perpendicularly to the fracture plane 45, as shown in FIGS. 2 and 7. The pins 51 are slidably disposed within aligned holes 53 in the mandrel 34, which are located in a medial portion of the loading section. A pair of steel sockets 52 extend diametrically in the member 41, each socket 52 extending though the sidewall of the member 41 and bonded therein in permanent, sealed fashion. Each anchor pin 51 is secured to a plug 50 that is removably secured in a respective socket 52 by threads or the like, so that the anchor pins may be replaced as required. The anchor pins 51 serve to maintain longitudinal alignment of the outer member 41 and the mandrel 34 during expansion and retraction of the member 41, thereby avoiding shear stresses on sensors (described below) and permitting reiterative use of the probe without distortion of the components thereof.

Figure 4:
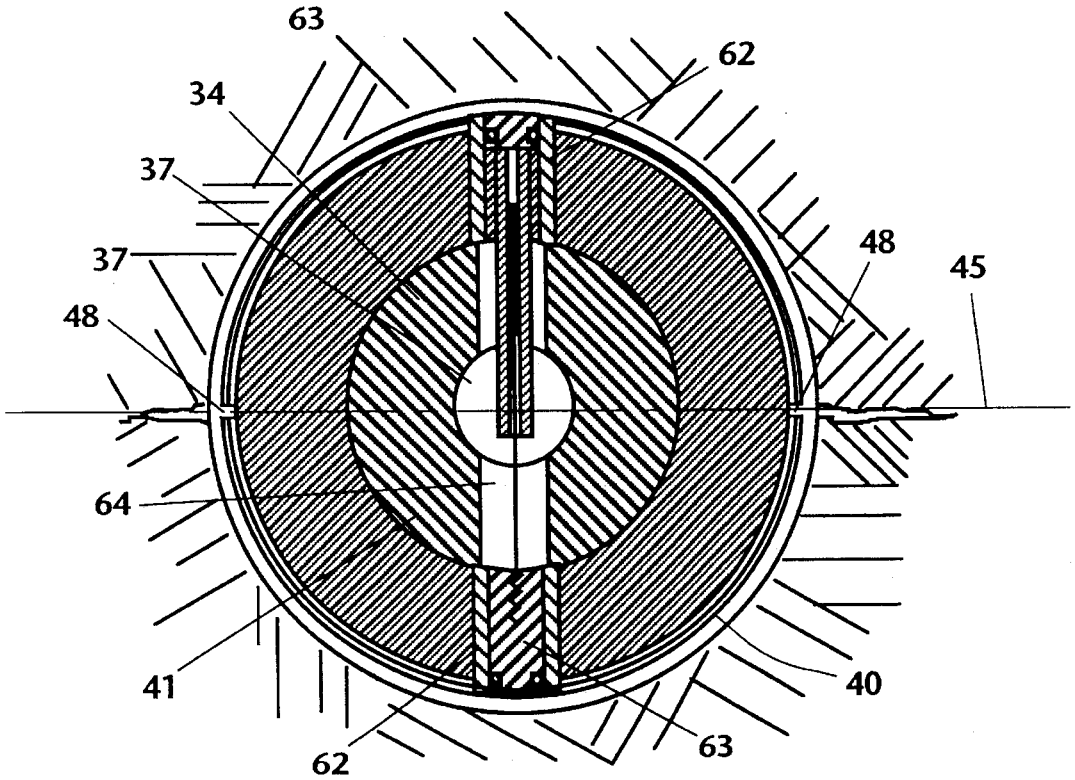
FIG. 4 is a cross-sectional end view of the probe, taken diametrically through an LVDT mounted in the probe.
Figure 5:
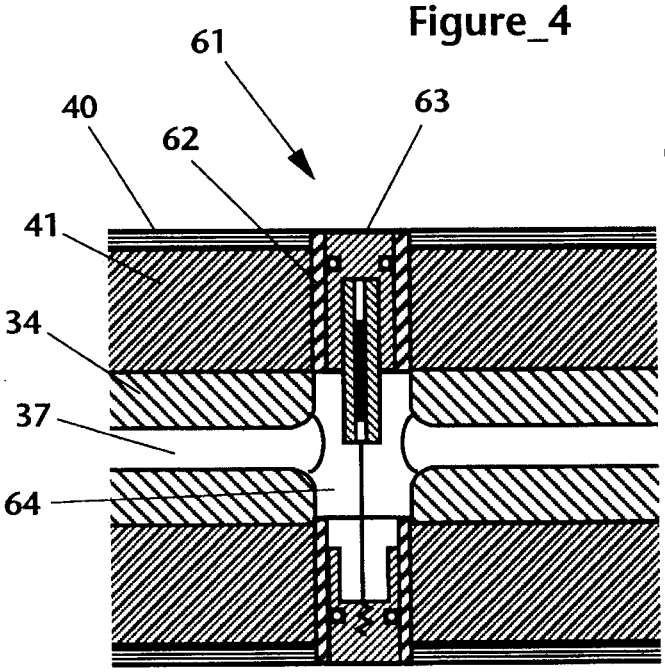
FIG. 5 is a cross-sectional side elevation of the probe taken through a medial portion and showing an LVDT mounted in the probe.

A plurality of LVDT sensor assemblies 61 are installed within the loading section 21 to measure diametrical expansion of the probe against the borehole wall. The LVDT assemblies are spaced longitudinally along the loading section 21 and extend diametrically and perpendicularly to the fracture plane 45. As shown particularly in FIGS. 4 and 5, each assembly 61 includes a pair of steel sockets 62 extending diametrically through the sidewall of the member 41 and permanently bonded and sealed therein. A pair of threaded plugs 63 are removably secured in the sockets 62, and the moving core and a concentric sensor coil of each LVDT sensor are secured to respective plugs 63, so that each component or sensor assembly may be removed or replaced with ease. A bore 64 extends diametrically through the mandrel 34 at each LVDT installation to permit free translation of the core in the sensor coil, so that expansion and contraction of the member 41 due to hydraulic pressure may be measured with great accuracy. As noted in FIG. 2, two LVDT sensors may be disposed in spaced apart relationship above the anchor pins 51, and two may be disposed in like array below the anchor pins. The number and spacing of the sensors may be selected for particular applications.

Figure 6:
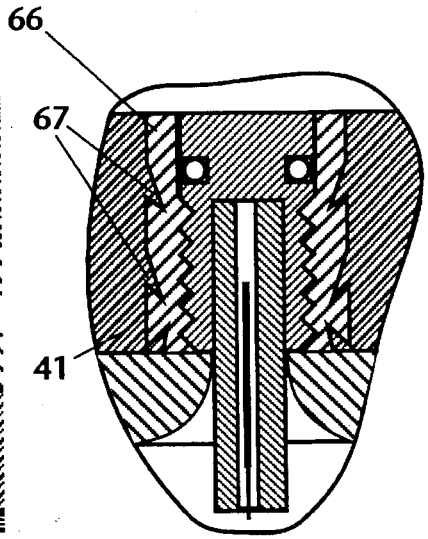
FIG. 6 is an enlarged cross-sectional side elevation of an alternative embodiment of the LVDT mounting plug.

With regard to FIG. 6, the LVDT assembly may alternatively include a socket 66 having a plurality of annular grooves 67 formed in the outer surface thereof. The grooves 67 flare outwardly toward the periphery of the probe to define with the member 41 a series of annular ridges that significantly increase the strength of the bond between the socket 66 and the member 41. The grooves 67 thus act to improve the resistance of the socket 66 to outward movement within the member 41 due to the high force applied by the hydraulic inflation pressure within the probe.

Figure 8:
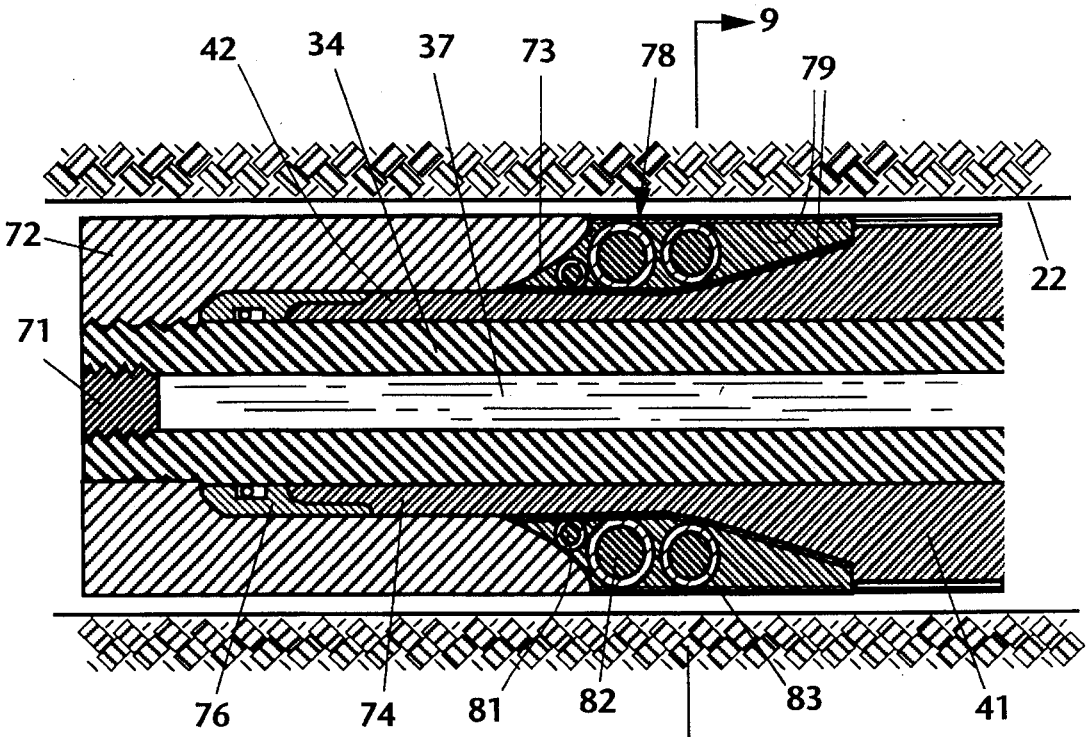
FIG. 8 is an enlarged cross-sectional side elevation depicting the end cap assembly of the probe.

Referring to FIG. 8, the frontal end of the mandrel 34 is fitted with a threaded plug to seal the interior space 37 and retain fluid pressure therein. A cup-shaped steel frontal end cap 72 is secured by threads to the outer surface of the frontal end of the mandrel 34, and includes an inwardly flaring portion 73. The expansion member 41 includes a tapered frontal end 74 that is received between the frontal end of the mandrel 34 and the interior of the frontal end cap 72. A bushing 76 is secured within the end cap 72 by cement bonding at the termination of the member 41, and supports an O-ring seal to prevent fluid loss from the interstitial space 42 through the threaded end of the mandrel.

Figure 9:
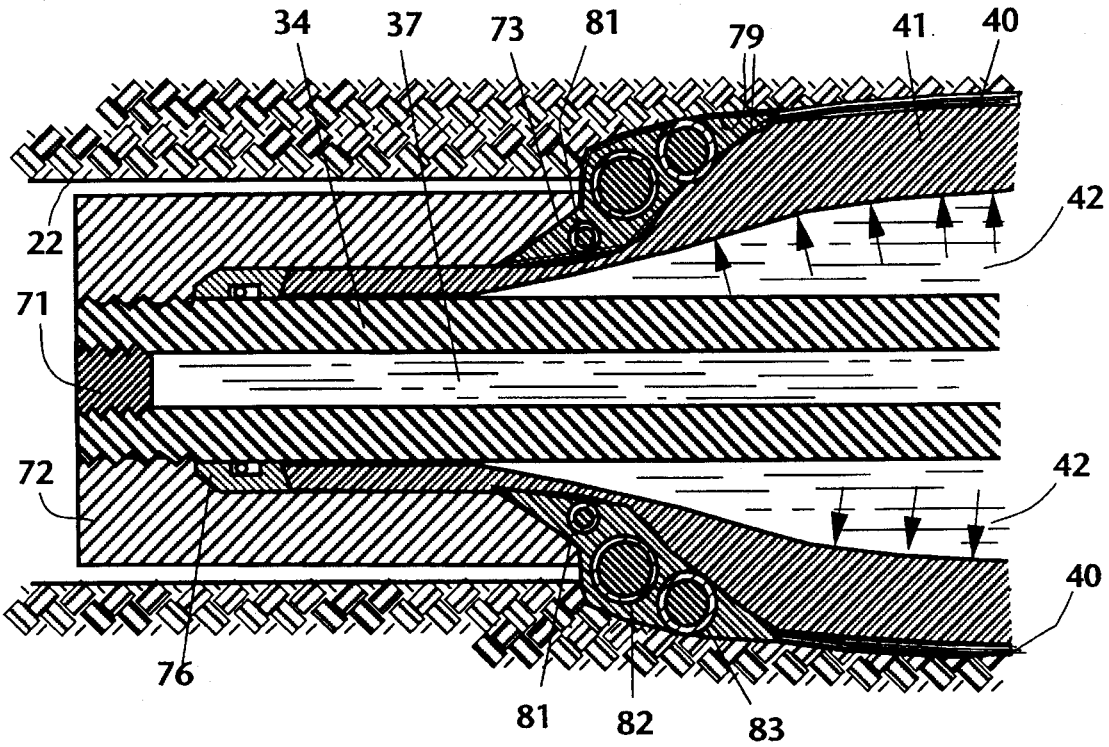
FIG. 9 is an enlarged cross-sectional side elevation as in FIG. 8, showing the end cap deformation during probe expansion.

A significant component of the loading 21 is a seal assembly 78 disposed at the conjunction of the flared end 73 of the end cap 71 and the tapered end 74 of the expansion member 41. The seal assembly 78 is formed of an elastic polymer material that is relatively harder than the member 41 and softer than the end cap 72, and is provided as a transition between the expandable member 41 and the rigid end cap 72. That is, the seal assembly 78 protects the member 41 during expansion from damage or rupture, by preventing extrusion or plastic deformation of the member 41 at the end cap conjunction, as depicted in FIG. 9.

Figure 10:
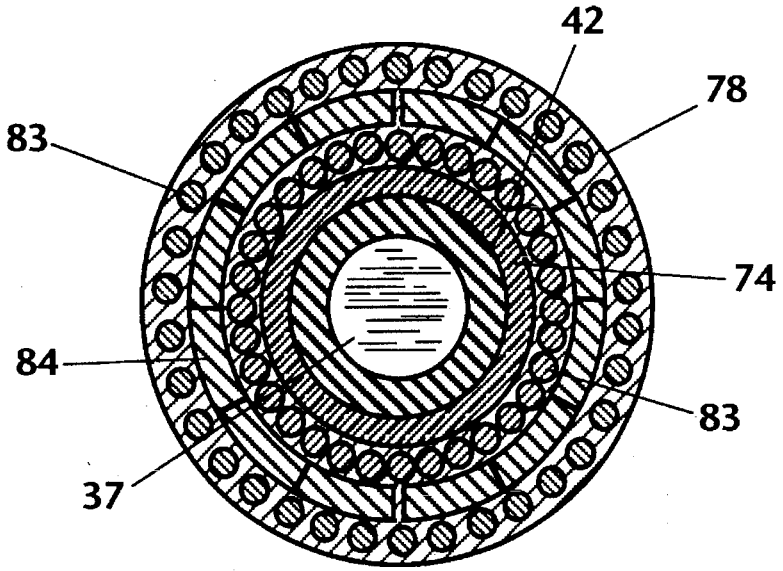
FIG. 10 is a cross-sectional end elevation depicting the skeletal coil springs of the end cap seal assembly.

The seal assembly 78 is provided with a wedge-shaped cross-sectional configuration which impinges conformally both on the flared end 73 of the end cap and on the tapered surface 74 of the member 41. The inner and outer surfaces of the seal assembly 78 are provided with high strength (Kevlar or equivalent) fiber reinforcement 79 bonded to the polymer material thereof. The fibers 79 are oriented longitudinally to permit circumferential expansion of the seal while restricting longitudinal expansion. With additional reference to FIG. 9, a plurality of helical coil springs 81, 82, and 83 are embedded within the polymer material of the seal to provide the basic skeletal integrity and rigidity to the seal, primarily in the longitudinal direction. As shown in FIG. 10, a plurality of steel fingers 84 are disposed within the interior space of each spring 81–83 to permit circumferential spring expansion and contraction while filling the interior spring space to prevent crushing of the springs by the high force created by the expanding member 41.

The small diameter spring 81 is disposed concentrically within the flared end of the end cap 73. As shown in FIG. 9, during inflation of the expansion member 41 the spring 81 retains the outer end of the seal 78 within the flared end 73 to maintain the integrity of the assembly of the loading section. The larger springs 82 and 83 interacting with the surface fibers restrict the longitudinal deformation of the seal 78, but expand sufficiently in the circumferential direction to permit the expansion member 41 to form a smooth transition between maximum expansion at a medial portion of the probe and no expansion at the lower end 74 of the member 41. The springs 82 and 83 also exert a high restoring force which contracts the seal 78 after inflation and returns the seal assembly to the quiescent state of FIG. 8. The basal end seal 46 functions identically to the frontal seal 78 as described above.

The construction of the loading section 21 described above permits the quick replacement of components or the entire section, which is a great advantage in the field. The LVDT sensors, anchor pin, expansion member 41, seals, mandrel, and both basal and frontal end cap assemblies are all accessible and replaceable using the simple threaded connections between the components.

Figure 13:
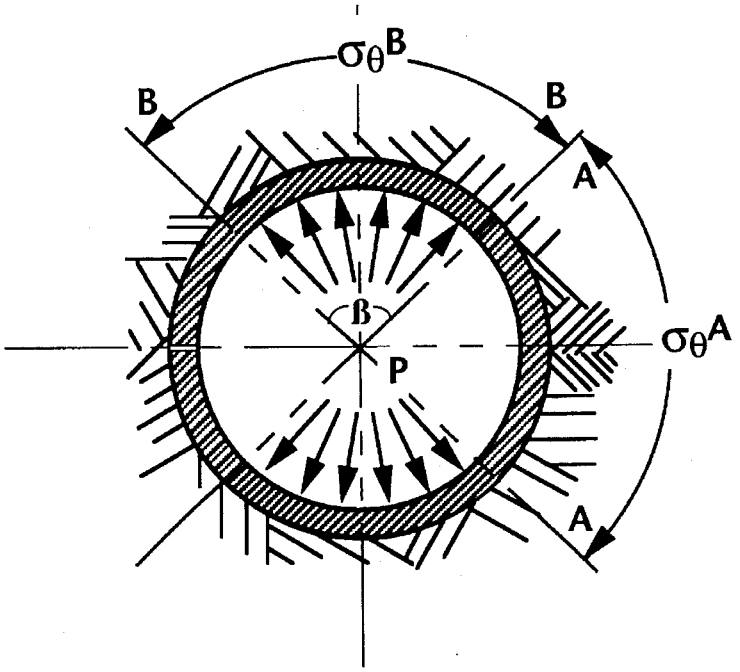
FIG. 13 is a diagram depicting the configuration of the loading pressure in relation to the loading angle $\beta$.
Figure 14:
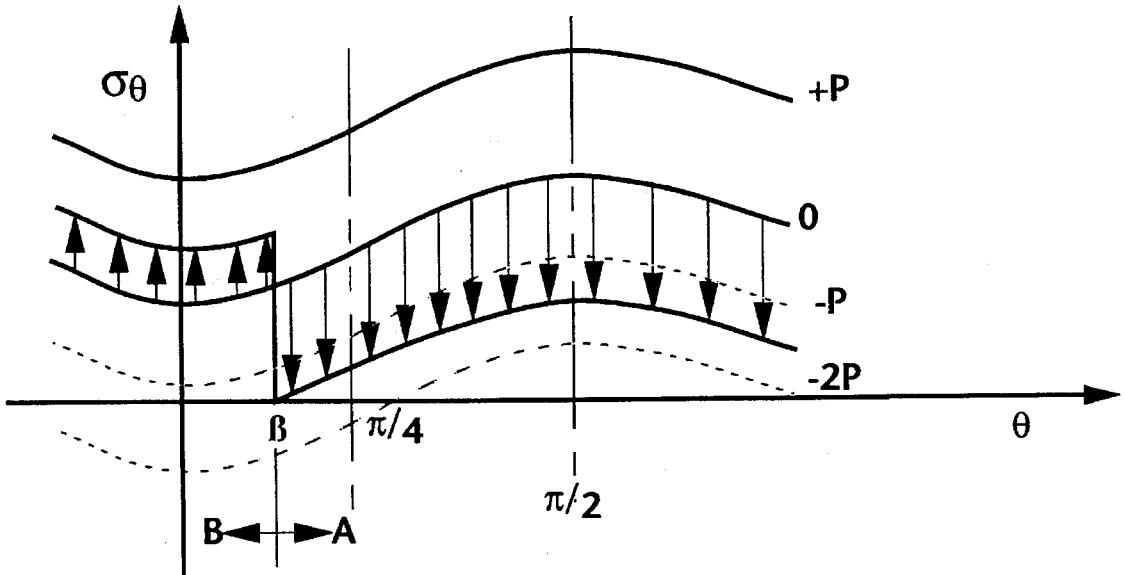
FIG. 14 is a graphic representation of tangential stress at the borehole boundary versus angular orientation about the borehole probe, as diagrammed in FIG. 13.

A further significant aspect of the construction of the probe is the high friction surface formed by the wire mesh 49 bonded to the outer surface of the expansion member 41. During inflation of the expansion member into the borehole wall, the wire mesh is driven into the borehole boundary, consolidating the boundary and overcoming the effects of micro-fractures and other anomalies. The theoretical implications of this effect are illustrated in FIGS. 13 and 14, in which the induced tangential stress $\sigma_\theta$ is correlated with the angular area $\beta$ covered by the high friction surface. Assuming a friction locked interface at the borehole boundary, the tangential stresses in areas under the high friction surface ($\sigma_\theta^B$) and in non-friction locked areas ($\sigma_\theta^A$) can be expressed as follows:

For general rock ($E << 30 \times 10^6$ psi:

$$\sigma_\theta^A = \sigma_\theta - (4\beta/\pi)p$$
$$\sigma_\theta^B = \sigma_\theta + \{2\beta/\pi + (1/2\pi)\Sigma 3/(m+1)\sin(m+1)2\beta\}p$$

For extremely hard rock ($E < 10 \times 10^6$ psi;

$$\sigma_\theta^A = \sigma_\theta - (4\beta/\pi)p$$
$$\sigma_\theta^B = \sigma_\theta + (4\beta/\pi)p$$

Figure 17:
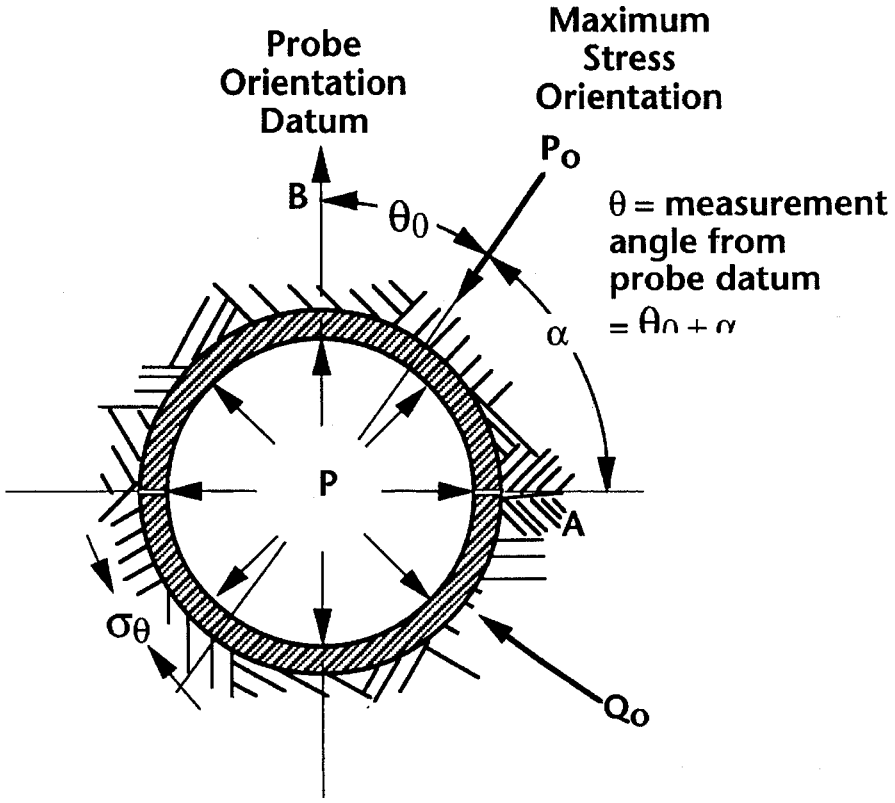
FIG. 17 is a diagram depicting the relationships of probe orientation in the borehole and maximum stress orientation in the surrounding media.
Figure 18:
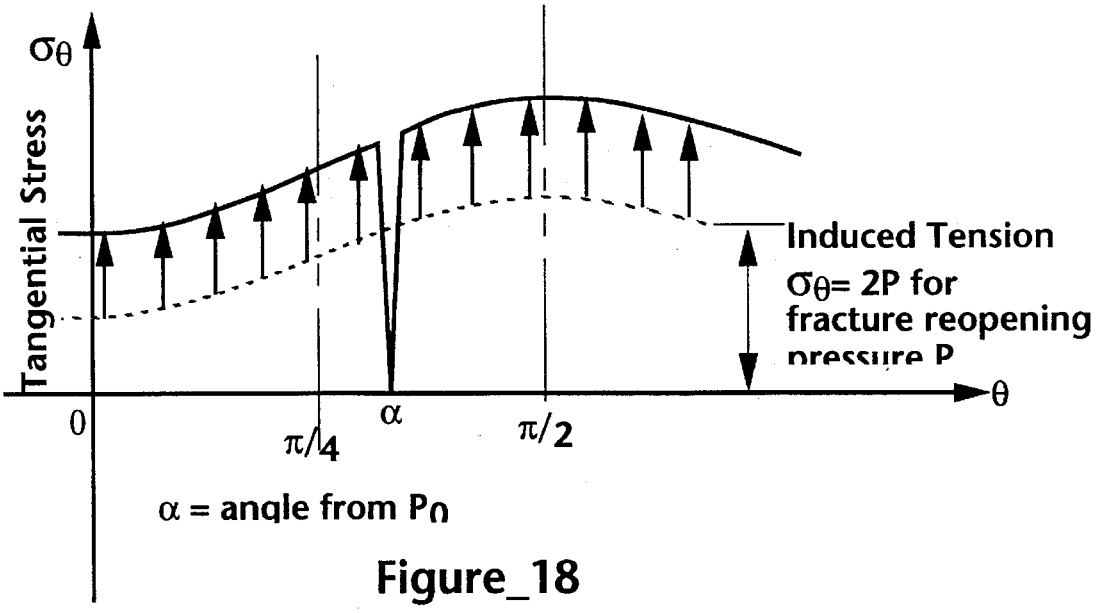
FIG. 18 is a graphic representation of tangential stress at the borehole boundary, including borehole wall compression and tension, induced by probe expansion.

When the angle $\beta$ approaches $\pi/2$, as shown in FIGS. 17 and 18, the stress distribution becomes unique, and the strong tensile effect is induced along the slots 48 (the fracture plane 45) of the probe. The tension effect is sharply concentrated at the fracture plane with a constant value of $\sigma_\theta=\sigma_\theta^A=2p$, regardless of the stiffness and fracture condition of the ground. The stress state values $P_o$, $Q_o$, and $\theta_o$ are calculated using the free fracture reopening pressure value $p=p_i^E=\sigma_\theta$, as follows:

$$p_i^E=(1/2)[3Q_o-P_o)+4(P_o-Q_o)\sin^2(\theta_o+\alpha_i)]$$

where $\theta_o$ is the angle of $P_o$ from the probe datum and $\alpha_i$ is the angle of the fracture plane 45 from the $P_o$ angle. The probe datum is conveniently set at each measurement such as magnetic north in vertical holes and the gravity direction in horizontal direction). In order to determine the three unknowns, measurements are made for at least a set of three different angles $\theta_i=(\theta_o+\alpha_i)$, usually at 0, 60, and 120 degrees, and the equations are solved simultaneously. Higher measurement accuracy may be obtained with an i value more than three, as needed.

The material properties of the earthen media may be calculated according to the theoretical relationships, as follows.

| | |
|---|---|
| Young's modulus: | $E_E = (1 + v)(D/\Delta D_E)\Delta p$ |
| Deformation modulus: | $E_T = (1 + v)(D/\Delta D_T)\Delta p$ |
| Non-elastic coefficient: | $\Delta E = (1 + v)D\Delta p(\Delta D_T-\Delta D_E)/\Delta D_T\Delta D_E$ |
| Tensile strength: | $T = 2(p^E-p^B)$ |

where:

$v$=Poisson's ratio

D=borehole diameter $\Delta D_E$=elastic portion of diametrical deformation $\Delta D_T$=total diametrical deformation $\Delta p$=applied pressure $p^B$=fracture initiation pressure $p^E$=pressure required to reopen previously induced fracture In its broadest aspects, the method of the invention, which is termed a single fracture method, comprises the step of placing the probe 21 in a borehole 22, as shown in FIG. 1, with the fracture plane 45 (defined by the two slots 48 in the probe surface) at a known angle about the borehole axis. High pressure hydraulic fluid is applied to the probe to drive the expandable member 41 into the borehole wall 22, as shown in FIG. 9. The LVDT sensors 61 measure the borehole deformation in response to the applied pressure. The initial tangential stress at the borehole boundary is increased by the frictional impingement of the probe surface, as shown in FIG. 18, except at the fracture plane 45, where the diverging halves of the probe abruptly induce tension in the borehole boundary (FIG. 12). As pressure is increased, the borehole wall eventually fractures. The LVDT readings and expansion pressure data are recorded. This process is repeated to obtain readings for both pressures required to initiate the fracture and reopen the fracture.

Figure 15:
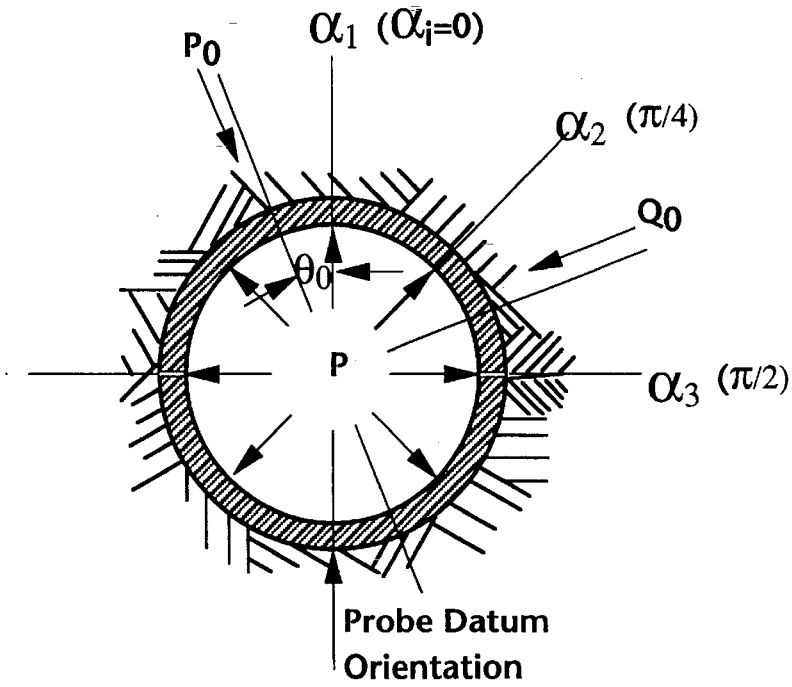
FIG. 15 is a diagram depicting a set of three fracture planes in differing angular orientations for determining of principle stress vectors.
Figure 16:
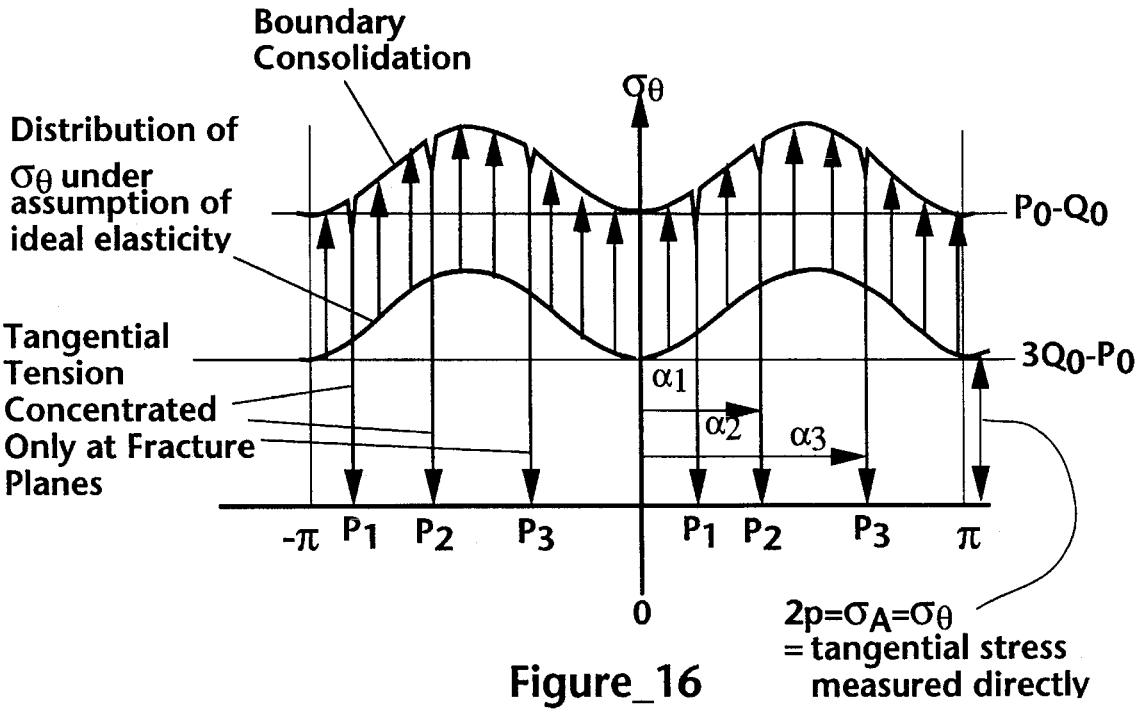
FIG. 16 is a graphic representation of tangential stress at the borehole boundary versus angular orientation, showing the effect of the three fracture planes depicted in FIG. 15.

Subsequently, the probe is deflated (FIG. 8), the probe is rotated through a selected angle $\alpha_2$ (FIG. 15), and the expansion process is reiterated to create another fracture along the datum plane of the probe at the new angular disposition. After a further reiteration of this process, three values are obtained for solving the three simultaneous equations:

$$p^E_1=(1/2)[3Q_o-P_o)+4(P_o-Q_o)\sin^2(\theta_o+\alpha_i)]$$

$$p^E_2=(1/2)[3Q_o-P_o)+4(P_o-Q_o)\sin^2(\theta_o+\alpha_2)]$$

$$p^E_3=(1/2)[3Q_o-P_o)+4(P_o-Q_o)\sin^2(\theta_o+\alpha_3)]$$

where $P_o$ and $Q_o$ represent the principal stress vectors. It is clear that the minimum required number of measurements is two when $\theta$ is known, and the number is three when $\theta$ is unknown. Here $\theta$ is the angle of the maximum principal stress $P_o$ for the probe orientation datum as shown in FIG. 15. For the unknown case, spacing the measurements at 60° about the borehole axis divides the whole circle of $2\pi$ radians in equal angles. The statistical accuracy of the process can be enhanced by increasing the number of measurements up to six, and spacing the measurements at 30° separation.

It should be emphasized that the method of the invention permits the direct determination of tangential stress from the relationship $\sigma_\theta=\sigma_\theta^A 2p$. This determination is not dependent upon any theoretical assumption, but is read directly from the data observed in real time. This direct observation of a primary stress factor is a great improvement over prior art methods, such as overcoring, hydrofracture, or the double fracture method. These prior art methods derive, rather than observe the tangential stress reading based on the theory of elasticity. However, the underground media rarely conforms to ideal elastic behavior, and these prior art methods are thus unreliable.

Figure 19:
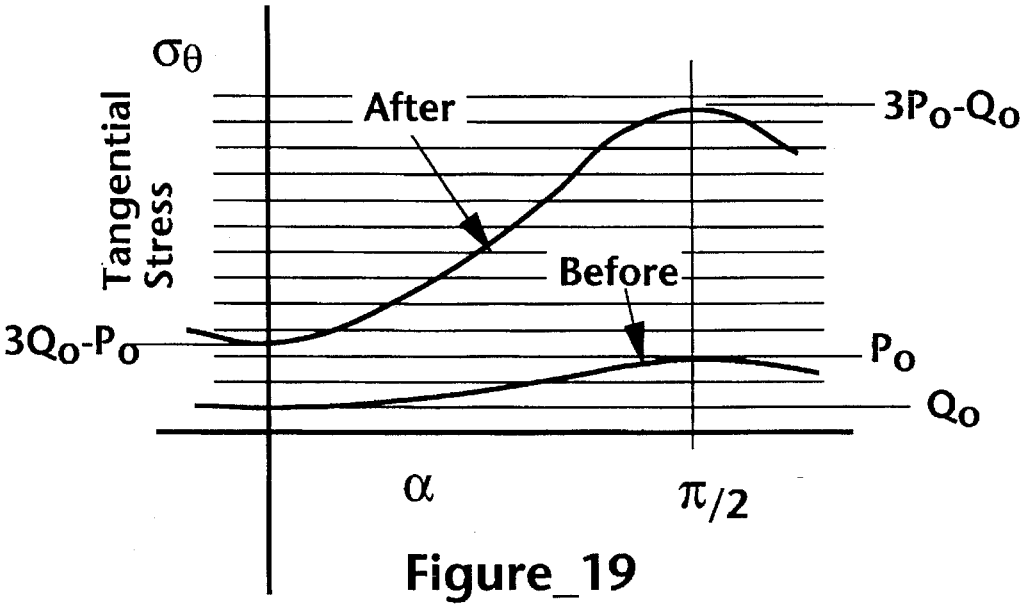
FIG. 19 is a graph depicting angular distribution of stresses, showing the relationship between tangential stresses and ambient ground stress state.
Figure 20:
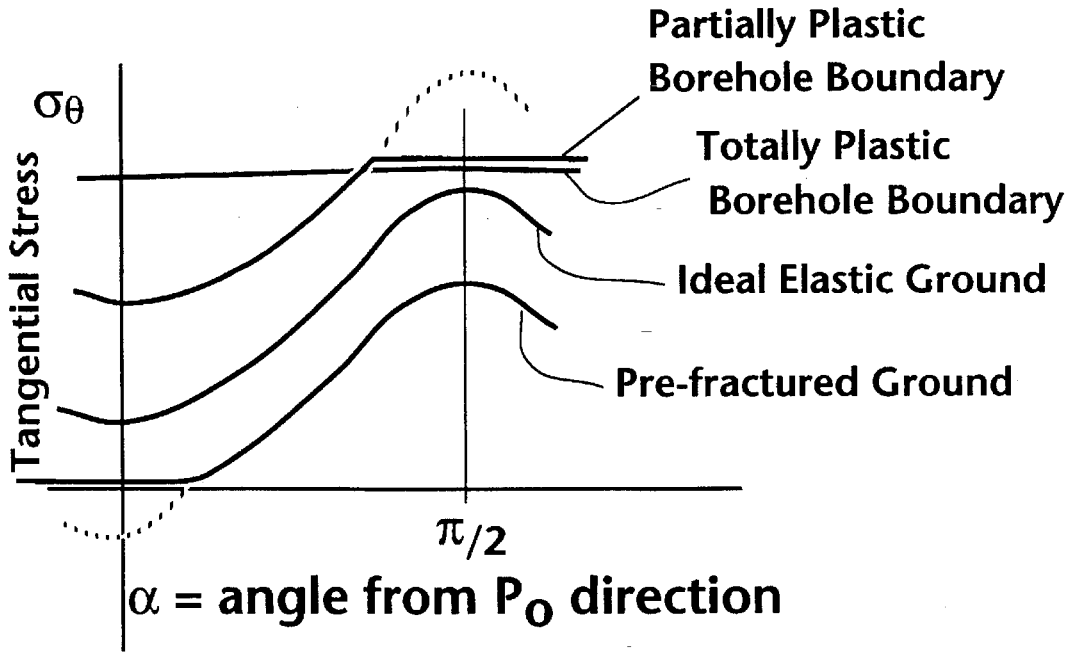
FIG. 20 is a graph depicting tangential stress versus borehole angle, showing variations in distribution patterns disclosing various non-elastic conditions of the borehole boundary.

With regard to FIGS. 19 and 20, it has been observed that the introduction of a borehole into otherwise undisturbed underground media causes concentrations of stresses at the borehole boundary. The curve labeled "Before" in FIG. 19 depicts the angular distribution of the ambient stress field, whereas the "After" curve shows the amplification of stress due to stress concentration at the boundary. The high concentration of stress causes the media to diverge from ideal elastic behavior, even if it was truly elastic before disruption. The angular distribution of tangential stress in ideal elastic ground, shown in FIG. 20, which approximates a sinusoidal curve, is difficult to observe because of the following complicating factors found in real underground situations. Plastic yielding of a portion of the boundary under concentrated compressive stress results in a distorted stress distribution curve (labeled "Totally Plastic/Partially Plastic Borehole Boundary"), while concentration of tensile stress causes fracturing failure of other portions of the boundary and results in a distorted stress distribution curve (labeled "Prefractured Ground"). For both these distorted sinusoidal stress distribution characteristics, the actual sinusoidal stress curve may be determined from the direct measurement of the totality of the $\sigma_\theta$ distribution. The nature and magnitude of the deviation from the ideal elasticity can be analyzed mathematically as well as by means of the finite element modeling method. These modeling algorithms are readily available for a wide range of popular computers. The accuracy of the measurement can be increased statistically with a larger number of measurements. In the case of totally plastic ground, the magnitude of the diametric deformation varies sharply in relation to the angular orientation, despite the uniform $\sigma_\theta$ values all around the boundary. The magnitude and orientation of the deformation reflect both the stress state and material properties, which are best determined by applying finite element computer model analysis to the measured data.

The accuracy of the analysis can be increased statistically with a larger number of measurements for disclosing the boundary stresses and diametric deformations.

A more serious challenge to measurement of underground stress and material properties occurs in media that diverges markedly from ideal elastic or ideally plastic behavior. Rock formations are usually infested by pre-existing and potential fractures, regardless of depth, due to tectonic destruction at great depths and weathering effects near the surface. Stress measurement of high accuracy has been considered impossible in the prior art due to the dominant presence of fractures, as well as other anomalous conditions. The present invention provides a method to overcome this fundamental difficulty and obtain meaningful measurements of underground stress conditions.

In the initial operation of the borehole probe of the invention, a preliminary examination is made of the ground condition at a prospective probe position regarding both ground texture (elastic or plastic) and composition (fracture-infested or cavernous). Results of the preliminary examination allow users to evaluate the probe location and choose the best available probe positions for each test in a given borehole. Due to the uncertainty and complexity of ground conditions, a slight shifting of the probe position in a given location can often provide a drastic improvement in measurement results. This preliminary examination can be carried out in a matter of minutes, whereas conventional methods such as overcoring and other laboratory-based procedures typically requires days to determine that measurements are based on faulty or indeterminate ground conditions.

Figure 21:
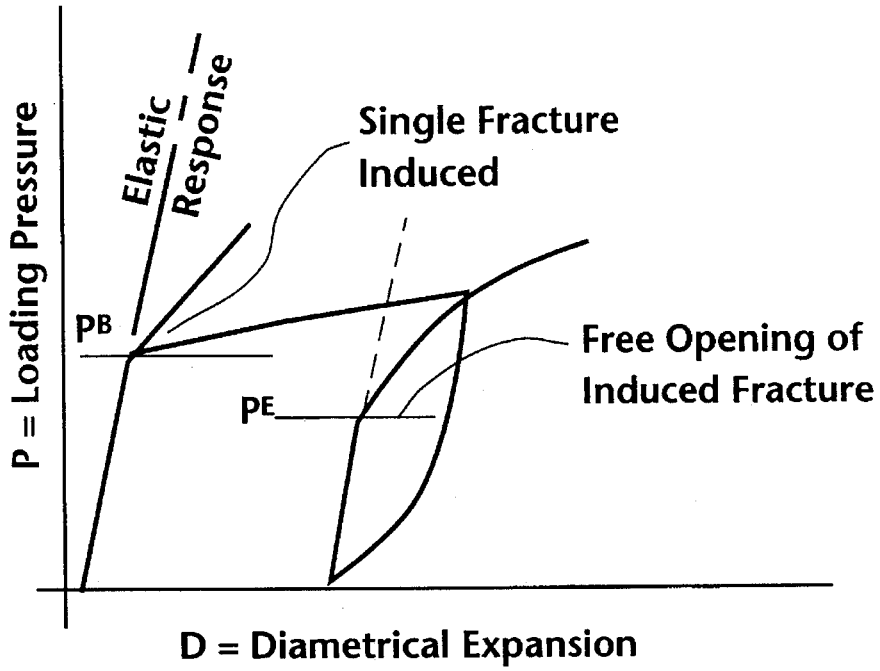
FIG. 21 is a graph depicting loading pressure versus diametrical expansion of a borehole, showing sharp single fracturing and reopening of the fracture plane.
Figure 22:
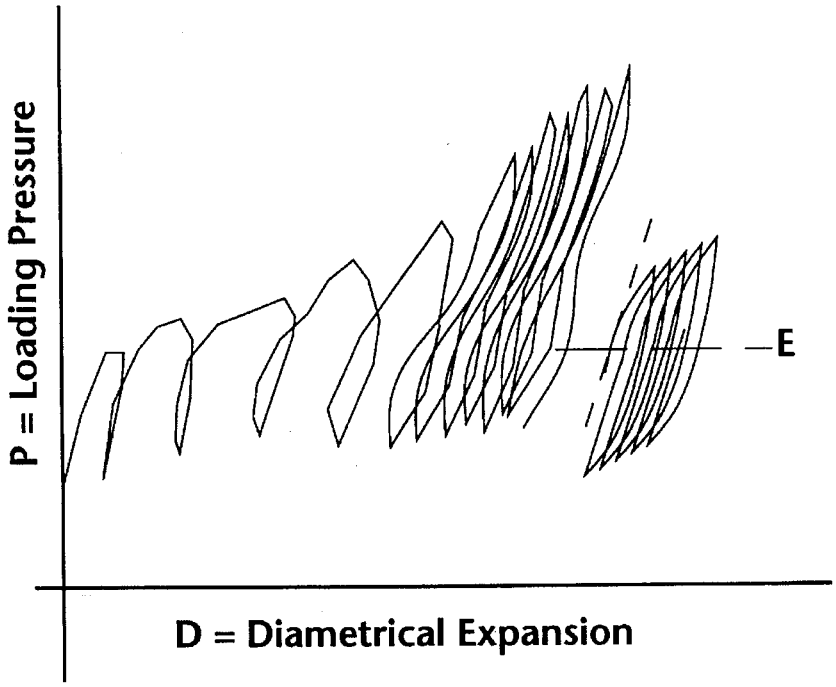
FIG. 22 is a graph depicting loading pressure versus diametrical expansion of a borehole, showing the application of reiterative loading to consolidate fractured ground to obtain stress state and material properties data.

As shown in FIG. 21, preliminary examination of ground condition is carried out by expanding the probe and observing diametrical expansion in any desired borehole orientation. Initial observation of this relationship quickly yields a characterization of the ground media, whether plastic, ideal elastic, or fractured/cavernous. The inflection point of the ideal curve from linear to curved with decreased slope indicates $p^E$, which may be read directly from the graph. Based on these initial observation, measurement may proceed as described previously, or the probe may be relocated to a new borehole location to seek better measurement conditions. Alternatively, if the ground is found to be fracture-infested or cavernous, the probe may be expanded and retracted cyclically and reiteratively, as shown also in FIG. 21, to consolidate the fractured boundary. This procedure alters the material properties to a pseudo-elastic state, enabling a meaningful measurement of $p^E$ and calculation of other characteristics therefrom.

A further advantage of the invention, as depicted in FIG. 1, is that variations in diametrical deformation measured by the separate LVDT sensors 61 may be plotted to detect localized variations in material properties along the axis of the borehole, and to assess the presence and extent of the localized material property anomalies in the axial direction within the loaded zone at the measurement position. This data may provide information on the three dimensional variation of the material properties, such as discontinuities and weakness planes in real time, enabling evaluation, design and construction of underground structures at the time of construction as well as their aging, and deterioration with time.

The apparatus of the invention, which directs expansion and fracturing of the borehole boundary, facilitates the single fracture method of the invention for determining underground stress state and material properties. The ability of the probe to create and evaluate one clearly defined fracture at any desired angular orientation is achieved by the innovative scheme of consolidating the entire borehole boundary to virtually solidify and overcome any random fractures except at the predetermined fracture plane. This selective single fracture method is a significant improvement over the prior art, as it overcomes a fundamental difficulty in underground measurement due to non-uniformities, discontinuities, stratification, prefractures, microfractures, and the like.

The apparatus is adapted for rapid data acquisition and analysis. The entire measurement operation, including preliminary evaluation for suitability of testing position in a borehole, data collection and analysis, and graphical display of results may be performed virtually automatically in real time at the test site. Furthermore, the computerized methodology enables monitoring and recording of time-dependent changes of the stress states and material properties in the ground. These characteristics are in stark contrast to conventional methods, which often require either extensive manipulation within a borehole, or removal of samples from a borehole for laboratory analysis.

The accuracy and reliability of data from the probe is far better than prior art approaches can yield in the measurement of both stress states and material properties. The ability of the invention to provide data on the tectonic component of the underground stress field is unmatched in prior art methodology.

I claim:

1. A method for determining the stress state and material properties in underground media surrounding a borehole, comprising the steps of:

placing an expandable probe into said borehole at a first angular orientation about the axis of said borehole;

expanding said probe under the control of applied fluid pressure diametrically from a datum plane corresponding to said first angular orientation under increasing fluid pressure to impinge upon and deform the borehole wall and to fracture the underground media along said datum plane, while simultaneously obtaining data by measuring the diametrical expansion of said probe orthogonal to said datum plane and the fluid pressure expanding said probe;

deflating said probe under decreasing fluid pressure and re-expanding said probe from said datum plane under increasing fluid pressure while simultaneously measuring the diametrical re-expansion of said probe and the fluid pressure;

rotating said probe in said borehole to a second angular orientation about said axis;

repeating said expanding, deflating, re-expanding and rotating steps reiteratively; and, analyzing said diametrical expansion data with respect to said pressure data to determine the angular distribution of the tangential stress and material properties of the ground media around said borehole.

2. The method of claim 1, further including the step of measuring axial variations in diametrical expansion of said borehole during each expansion step of said probe to determine the axial variation of material properties within the axial length of the probe.

3. The method of claim 1, further including the step of repositioning the probe at a differing depth within the same borehole, and thereafter carrying out said expanding, deflating, re-expanding and rotating steps reiteratively; and, analyzing said diametrical expansion data with respect to said pressure data to determine the angular distribution of the tangential stress and material properties of the ground media at said differing depth around said borehole.

4. An apparatus for measuring stress state and material properties in underground media surrounding a borehole, including;

a tubular central mandrel extending along an axis of symmetry common to the apparatus and borehole;

a tubular expansion member disposed concentrically about said mandrel;

means for delivering high pressure hydraulic fluid through said mandrel to inflate said tubular expansion member and impinge on and deform the wall of the borehole;

means for joining said tubular expansion member to said mandrel to retain high pressure fluid within said tubular expansion member;

means for defining a datum plane of said apparatus, said datum plane passing through said axis;

means for directing expansion of said tubular expansion member in a direction orthogonal to said datum plane;

sensor means for measuring the expansion of the outer surface of said tubular expansion member from said datum plane as a function of loading pressure.

5. The apparatus of claim 4, wherein said means for directing expansion includes a first layer of high strength fibers bonded to said outer surface of said tubular expansion member to confine circumferential expansion of said outer surface, and a pair of slots formed in said first layer to sever said high strength fibers.

6. The apparatus of claim 5, wherein said pair of slots extend longitudinally parallel to said axis and are disposed in said datum plane.

7. The apparatus of claim 4, further including means for providing a high friction contact surface to engage the borehole wall and consolidate the borehole wall under tangential compression during inflation of said tubular expansion member.

8. The apparatus of claim 7, wherein said high friction contact means includes a second layer of high strength fibers bonded to said outer surface of said tubular expansion member.

9. The apparatus of claim 8, wherein said second layer of high strength fibers extend generally longitudinally parallel to said axis.

10. The apparatus of claim 9, wherein said second layer of high strength fibers comprises a steel wire mesh.

11. The apparatus of claim 9, wherein said means for directing expansion includes a first layer of high strength fibers bonded to said tubular expansion member concentrically within said second layer to confine circumferential expansion of said outer surface, and a pair of slots extending through said first and second layers in said datum plane.

12. The apparatus of claim 4, further including end cap means for joining said tubular expansion member to said mandrel to retain said high pressure hydraulic fluid.

13. The apparatus of claim 12, wherein said end cap means includes at least one end cap having a cup-like opening, said tubular expansion member including a tapered end portion shaped and dimensioned to be received within opening.

14. The apparatus of claim 13, wherein said opening includes an outwardly flaring portion, and further including an annular seal interposed between said outwardly flaring portion on said end cap means and the outer surface of said tapered end portion of said tubular expansion member.

15. The apparatus of claim 14, wherein said annular seal is formed of an elastic polymer material relatively harder than said tubular expansion member and relatively softer than said end cap.

16. The apparatus of claim 15, further including fiber means bonded in internal and external surfaces of said annular seal to permit circumferential expansion and limit longitudinal expansion of said annular seal.

17. The apparatus of claim 16, wherein said fiber means comprises high strength fibers extending generally longitudinally in said annular seal.

18. The apparatus of claim 15, further including at least one helical spring embedded in said elastic polymer material and disposed concentrically therein in toroidal fashion, said helical spring providing structural reinforcement for said annular seal.

19. The apparatus of claim 18, further including a plurality of finger members disposed to substantially fill the interior space of said helical spring.

20. The apparatus of claim 19, further including a plurality of said helical springs embedded in said annular seal in generally parallel disposition, at least one of said helical springs disposed in direct contact with said end cap.

21. The apparatus of claim 4, further including anchor pin means for maintaining longitudinal alignment of said tubular expansion member and said mandrel.

22. The apparatus of claim 21, wherein said anchor pin means includes a pair of anchor pins extending diametrically and orthogonal to said axis, said mandrel including a pair of aligned passages for receiving said anchor pins therethrough in slidable translation.

23. The apparatus of claim 22, further including plug means for securing an outer end of each of said pair of anchor pins to said tubular expansion member, an inner end of each of said pair of anchor pins extending through one of said pair of aligned passages in said mandrel.

24. The apparatus of claim 23, wherein said anchor pins extend diametrically and orthogonally to said datum plane.

25. The apparatus of claim 4, wherein said sensor means includes a plurality of LVDT sensors extending diametrically and orthogonally to said datum plane, said plurality of sensor spaced longitudinally in said apparatus.

26. The apparatus of claim 25, further including plug means for securing each of said sensors to said tubular expansion member.

27. The apparatus of claim 26, wherein said plug means includes a plurality of pairs of plugs for each of said sensors, said pairs of plugs permanently secured in said tubular expansion member, and threaded means for removably securing each of said LVDT sensors to a respective pair of plugs.

28. An apparatus for measuring stress state and material properties in underground media surrounding a borehole, including;

a tubular mandrel extending along an axis of symmetry;

a tubular expansion member disposed concentrically about said mandrel;

means for delivering high pressure hydraulic fluid through said mandrel to inflate said tubular expansion member and impinge on and deform the wall of the borehole;

means for directing expansion of said tubular expansion member in a direction orthogonal to a datum plane passing through said axis;

sensor means for measuring the expansion of the outer surface of said tubular expansion member as a function of loading pressure;

means for providing a high friction contact to engage the borehole wall and consolidate the borehole wall under tangential compression during inflation of said tubular expansion member;

end cap means for joining said tubular expansion member to said mandrel to retain said high pressure hydraulic fluid, including a pair of end caps, each having a cup-like opening, said tubular expansion member including a tapered end portion shaped and dimensioned to be received within opening;

said opening including an outwardly flaring portion, and further including an annular seal formed of elastic polymer material that is interposed between said outwardly flaring portion and the outer surface of said tapered end portion of said tubular expansion member;

at least one helical spring embedded in said elastic polymer material and disposed concentrically therein in toroidal fashion, said helical spring limiting diametrical expansion of said annular seal;

a plurality of finger members disposed to substantially fill the interior space of said helical spring;

anchor pin means for maintaining longitudinal alignment of said tubular expansion member and said mandrel; and said sensor means including a plurality of LVDT sensors extending diametrically and orthogonally to said datum plane, said plurality of sensor spaced longitudinally in said apparatus.

29. A method for analyzing underground media surrounding a borehole, comprising the steps of:

placing an expandable probe into said borehole at a first angular orientation about the axis of said borehole;

defining a datum plane of said probe, said datum plane passing through said axis, said probe being expandable radially outwardly from said datum plane;

expanding said probe diametrically from said datum plane disposed at said first angular orientation under increasing fluid pressure to impinge upon and deform the borehole wall and to fracture the underground media along said datum plane, and, comparing the diametrical expansion of said probe orthogonal to said datum plane and the fluid pressure expanding said probe to determine if the underground media exhibits ideal elastic expansion characteristics, generally plastic characteristics, or generally highly fractured characteristics.

30. The method of claim 29, further including the steps of cyclically and reiteratively expanding and contracting said probe to consolidate generally highly fractured underground media and convert said media to a pseudo-elastic state through consolidation of said borehole wall.

31. The method of claim 30, further including the step of determining the tensile strength relative to a predetermined fracture orientation in the underground media surrounding said borehole wall by re-expanding said probe sufficiently to open the fracture previously formed in the borehole wall, observing the inflection points during initial expansion and re-expansion at which the relationship between diametrical expansion and fluid pressure abruptly deviates from a linear relationship to a decreasing slope, non-linear relationship, and calculating the arithmetic difference between the fluid pressure values at said inflection points of initial expansion and re-expansion to determine said tensile strength in the predetermined fracture plane.

32. The method of claim 31, further including the step of rotating said probe to a second angular orientation in the borehole, expanding said probe from a datum plane corresponding to said second angular orientation under increasing fluid pressure to impinge upon and deform the borehole wall and to fracture the underground media along said datum plane, and observe the fluid pressure required to fracture the underground media at the second angular orientation, thereafter repeating the steps of rotating the probe to a further angular orientation, expanding the probe and observing fluid pressure required to fracture the underground media at the further angular orientation.

33. The method of claim 32, further including the step of observing the minimum fluid pressure required to reopen a predetermined fracture plane existing naturally or prefractured by the probe at any angular orientation about the axis of the borehole, and doubling said minimum fluid pressure to obtain the tangential stress on the borehole wall.

34. The method of claim 32, further including reiterating the steps of rotating the probe to further angular orientations, expanding the probe and observing fluid pressure required to fracture the underground media at the further angular orientations to obtain additional data concerning a plurality of predetermined fracture planes and thereby increase the accuracy of calculations of ambient stress state and material properties.

35. The method of claim 32, further including increasing the accuracy of calculating the ambient stress state and material properties in complex, non-ideal ground conditions such as hard fractured rock and ductile soft media by applying finite element computer modeling analysis to the angular distribution of tangential stress and the diametrical deformation obtained by the repeated measurements at various angular orientations about the axis of the borehole.

36. The method of claim 29, further including the step of securing a high friction outer shell to said expandable probe, said step of expanding said probe driving said high friction shell into the borehole wall to consolidate material anomalies and existing fractures in the area of the borehole wall prior to fracturing the underground media along said datum plane.

* * * * *